US009670941B2

(12) United States Patent
Dalton et al.

(10) Patent No.: US 9,670,941 B2
(45) Date of Patent: Jun. 6, 2017

(54) HYDRAULIC DEVICES AND METHODS OF ACTUATING SAME

(71) Applicant: TRANSOCEAN INNOVATION LABS, LTD, George Town (KY)

(72) Inventors: John Matthew Dalton, Missouri City, TX (US); Terry Dickson, Inverness (GB)

(73) Assignee: TRANSOCEAN INNOVATION LABS LTD, George Town, Grand Cayman (KY)

( * ) Notice: Subject to any disclaimer, the term of this patent is extended or adjusted under 35 U.S.C. 154(b) by 293 days.

(21) Appl. No.: 14/506,421

(22) Filed: Oct. 3, 2014

(65) Prior Publication Data

US 2015/0096435 A1 Apr. 9, 2015

Related U.S. Application Data

(60) Provisional application No. 61/886,404, filed on Oct. 3, 2013.

(51) Int. Cl.

| | |
|---|---|
| ***F15B 13/00*** | (2006.01) |
| ***F15B 20/00*** | (2006.01) |
| ***F15B 11/036*** | (2006.01) |
| ***E21B 34/16*** | (2006.01) |

(52) U.S. Cl.

CPC ..... *F15B 20/00* (2013.01); *E21B 34/16* (2013.01); *F15B 11/0365* (2013.01); *F15B 2211/20576* (2013.01); *F15B 2211/265* (2013.01); *F15B 2211/7055* (2013.01); *F15B 2211/7056* (2013.01); *F15B 2211/8757* (2013.01)

(58) Field of Classification Search

CPC .... F15B 11/036; F15B 11/0365; F15B 20/005

See application file for complete search history.

(56) References Cited

U.S. PATENT DOCUMENTS

| | | | | |
|---|---|---|---|---|
| 3,295,420 | A | 1/1967 | Gleason | 91/216 R |
| 3,368,351 | A | 2/1968 | Wood et al. | 60/405 |
| 3,426,650 | A | 2/1969 | Jenney | 91/216 R |

(Continued)

OTHER PUBLICATIONS

International Search Report and Written Opinion in International Application No. PCT/US2014/059128 dated Jan. 2, 2015.

*Primary Examiner* — Michael Leslie

(74) *Attorney, Agent, or Firm* — Norton Rose Fulbright US LLP

(57) ABSTRACT

This disclosure includes hydraulic apparatuses and methods for redundant actuation of a hydraulic device. Some apparatuses include a hydraulic device having a first hydraulic actuator and a second hydraulic actuator, wherein each of the first and second hydraulic actuators comprises at least a first hydraulic cavity, a second hydraulic cavity, and a piston. Some apparatuses also include a controller coupled to the hydraulic device. In some embodiments, the controller is configured to receive hydraulic fluid from a fluid source via at least two parallel hydraulic lines coupled to the controller, select a first hydraulic line of the at least two parallel hydraulic lines, and transfer the hydraulic fluid from the selected first hydraulic line to a first cavity of the first hydraulic actuator to apply pressure to a first piston to actuate the hydraulic device.

12 Claims, 3 Drawing Sheets

(56) References Cited

U.S. PATENT DOCUMENTS

| | | | | |
|---|---|---|---|---|
| 4,807,516 | A * | 2/1989 | Takats | G05D 1/0077 91/509 |
| 5,819,632 | A * | 10/1998 | Moody | F15B 11/0365 91/519 |
| 6,227,112 | B1 * | 5/2001 | Becker | F15B 11/0365 101/230 |
| 7,870,728 | B2 | 1/2011 | Keuper et al. | 60/422 |
| 8,365,762 | B1 | 2/2013 | Trotter | 137/487.5 |

* cited by examiner

HYDRAULIC DEVICES AND METHODS OF ACTUATING SAME

CROSS-REFERENCE TO RELATED APPLICATIONS

This application claims priority to U.S. Provisional Application No. 61/886,404, entitled "NTH REDUNDANT HYDRAULIC ACTUATORS," filed Oct. 3, 2013, which is incorporated by reference in its entirety.

BACKGROUND

1. Field of Invention

The present invention relates generally to hydraulic actuators, and more specifically, but not by way of limitation, to redundant hydraulic actuators in control systems that include hydraulic controls.

2. Description of Related Art

Hydraulic systems employ numerous hydraulic devices to perform various functions. For example, a subsea blowout preventer (BOP) may employ hydraulic devices in the form of a ram, an annular, a connector, and a failsafe valve function. In the case of a BOP, when a hydraulic device malfunctions, is no longer usable, or leaks, drilling operations must to be suspended so that maintenance on the hydraulic device can be performed. As a result of the suspension of drilling operations, significant loss in revenue and/or significant costs are incurred.

SUMMARY

A hydraulic device may be actuated with redundant controls and/or actuators to improve the reliability, availability, fault tolerance, and/or safety of the hydraulic device, and to allow the hydraulic device to perform even after component failures. In some embodiments, a hydraulic apparatus that employs redundant actuation of a hydraulic device may include a hydraulic device having a first hydraulic actuator and a second hydraulic actuator, wherein each of the first and second hydraulic actuators comprises at least a first hydraulic cavity, a second hydraulic cavity, and a piston. The apparatus may also include a controller coupled to the hydraulic device, wherein the controller is configured to receive hydraulic fluid from a fluid source via at least two parallel hydraulic lines coupled to the controller. The controller may also be configured to select a first hydraulic line of at least two parallel hydraulic lines, and transfer the hydraulic fluid from the selected first hydraulic line to a first cavity of the first hydraulic actuator, wherein transferring the hydraulic fluid to the first cavity of the first hydraulic actuator applies pressure to a first piston to actuate the hydraulic device. In other words, the controller may also be configured to select a first hydraulic line of at least two parallel hydraulic lines, and transfer the hydraulic fluid from the selected first hydraulic line to a first cavity of the first hydraulic actuator to apply pressure to a first piston to actuate the hydraulic device.

According to an embodiment, the controller may be further configured to select a second hydraulic line of at least two hydraulic lines, and transfer the hydraulic fluid from the selected second hydraulic line to a first cavity of the second hydraulic actuator, wherein transferring the hydraulic fluid to the first cavity of the second hydraulic actuator applies pressure to a second piston to further actuate the hydraulic device. In other words, the controller may be further configured to select a second hydraulic line of at least two hydraulic lines, and transfer the hydraulic fluid from the selected second hydraulic line to a first cavity of the second hydraulic actuator to apply pressure to a second piston to further actuate the hydraulic device. In another embodiment, the controller may also be configured to transfer the hydraulic fluid from the selected first hydraulic line to a first cavity of the second hydraulic actuator, wherein transferring the hydraulic fluid to the first cavity of the second hydraulic actuator applies pressure to a second piston to further actuate the hydraulic device. In other words, the controller may also be configured to transfer the hydraulic fluid from the selected first hydraulic line to a first cavity of the second hydraulic actuator to apply pressure to a second piston to further actuate the hydraulic device.

In another embodiment, the controller may be configured to receive one or more signals from a plurality of sensors coupled to at least one of the first piston, the first cavity of the first hydraulic actuator, the second piston, and the first cavity of the second hydraulic actuator. The controller may be further configured to detect a failure associated with at least one of the first hydraulic actuator and the second hydraulic actuator based, at least in part, on the one or more signals received from the plurality of sensors. In some embodiments, the controller may also be configured to, upon detecting the failure, increase a pressure of the hydraulic fluid in at least one of the at least two parallel hydraulic lines to increase the pressure applied to at least one of the first piston and the second piston to further actuate the hydraulic device.

In some embodiments the first hydraulic actuator and the second hydraulic actuator may be coupled in series within the hydraulic device. In another embodiment, the first hydraulic actuator and the second hydraulic actuator may be coupled in parallel within the hydraulic device.

In some embodiments, a method for redundant actuation of a hydraulic device may include receiving, at a controller, hydraulic fluid from a fluid source via at least two parallel hydraulic lines coupled to the controller. The method may also include selecting, by the controller, a first hydraulic line of the at least two parallel hydraulic lines, and transferring, by the controller, the hydraulic fluid from the selected first hydraulic line to a first cavity of a first hydraulic actuator of a hydraulic device, wherein transferring the hydraulic fluid to the first cavity of the first hydraulic actuator applies pressure to a first piston to actuate the hydraulic device. In other words, the method may also include selecting, by the controller, a first hydraulic line of the at least two parallel hydraulic lines, and transferring, by the controller, the hydraulic fluid from the selected first hydraulic line to a first cavity of a first hydraulic actuator of a hydraulic device to apply pressure to a first piston to actuate the hydraulic device.

According to an embodiment, the method may further include selecting a second hydraulic line of the at least two hydraulic lines, and transferring the hydraulic fluid from the selected second hydraulic line to a first cavity of a second hydraulic actuator of the hydraulic device to apply pressure to a second piston to further actuate the hydraulic device. In some embodiments, the method may also include transferring the hydraulic fluid from the selected first hydraulic line to a first cavity of a second hydraulic actuator to apply pressure to a second piston to further actuate the hydraulic device.

In some embodiments, the method may include receiving one or more signals from a plurality of sensors coupled to at least one of the first piston, the first cavity of the first hydraulic actuator, a second piston, and a first cavity of a second hydraulic actuator. The method may also include detecting a failure associated with at least one of the first hydraulic actuator and the second hydraulic actuator based, at least in part, on the one or more signals received from the plurality of sensors. According to another embodiment, the method may further include, upon detecting the failure, increasing a pressure of the hydraulic fluid in at least one of the at least two parallel hydraulic lines to increase the pressure applied to at least one of the first piston and the second piston to further actuate the hydraulic device.

In an embodiment, the first hydraulic actuator and the second hydraulic actuator are coupled in series within the hydraulic device. In another embodiment, the first hydraulic actuator and the second hydraulic actuator are coupled in parallel within the hydraulic device.

As used in this disclosure, the term "blowout preventer" includes, but is not limited to, a single blowout preventer, as well as a blowout preventer assembly that may include more than one blowout preventer (e.g., a blowout preventer stack).

The term "coupled" is defined as connected, although not necessarily directly, and not necessarily mechanically; two items that are "coupled" may be unitary with each other. The terms "a" and "an" are defined as one or more unless this disclosure explicitly requires otherwise. The term "substantially" is defined as largely but not necessarily wholly what is specified (and includes what is specified; e.g., substantially 90 degrees includes 90 degrees and substantially parallel includes parallel), as understood by a person of ordinary skill in the art. In any disclosed embodiment, the terms "substantially," "approximately," and "about" may be substituted with "within [a percentage] of" what is specified, where the percentage includes 0.1, 1, 5, 10, and 20 percent.

Further, a device or system that is configured in a certain way is configured in at least that way, but it can also be configured in other ways than those specifically described.

The terms "comprise" (and any form of comprise, such as "comprises" and "comprising"), "have" (and any form of have, such as "has" and "having"), "include" (and any form of include, such as "includes" and "including"), and "contain" (and any form of contain, such as "contains" and "containing") are open-ended linking verbs. As a result, an apparatus that "comprises," "has," "includes," or "contains" one or more elements possesses those one or more elements, but is not limited to possessing only those elements. Likewise, a method that "comprises," "has," "includes," or "contains" one or more steps possesses those one or more steps, but is not limited to possessing only those one or more steps.

Any embodiment of any of the apparatuses, systems, and methods can consist of or consist essentially of—rather than comprise/include/contain/have—any of the described steps, elements, and/or features. Thus, in any of the claims, the term "consisting of" or "consisting essentially of" can be substituted for any of the open-ended linking verbs recited above, in order to change the scope of a given claim from what it would otherwise be using the open-ended linking verb.

The feature or features of one embodiment may be applied to other embodiments, even though not described or illustrated, unless expressly prohibited by this disclosure or the nature of the embodiments.

The foregoing has outlined rather broadly the features and technical advantages of the present invention in order that the detailed description of the invention that follows may be better understood. Additional features and advantages of the invention will be described hereinafter that form the subject of the claims of the invention. It should be appreciated by those skilled in the art that the concepts and specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features that are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

The following drawings illustrate by way of example and not limitation. For the sake of brevity and clarity, every feature of a given structure is not always labeled in every figure in which that structure appears. Identical reference numbers do not necessarily indicate an identical structure. Rather, the same reference number may be used to indicate a similar feature or a feature with similar functionality, as may non-identical reference numbers.

DETAILED DESCRIPTION OF ILLUSTRATIVE EMBODIMENTS

A hydraulic device may be actuated with redundant controls and/or actuators. The redundancy incorporated into the controls and/or actuators of a hydraulic device may improve the reliability, availability, fault tolerance, and/or safety of the hydraulic device and allow the hydraulic device to perform even after component failures. In some embodiments, the hydraulic device may include any function/structure coupled, for example, in fluid communication, to or part of a blowout preventer (BOP). By way of example, and not limitation, a hydraulic device associated with a BOP may include a ram, annular, accumulator, test valve, failsafe valve, kill and/or choke line and/or valve, riser joint, hydraulic connector, and/or the like. In general, a BOP may be used on land or subsea, which can include water depths of a few meters deep to water depths of kilometers deep (also known as deep water).

Figure 1:
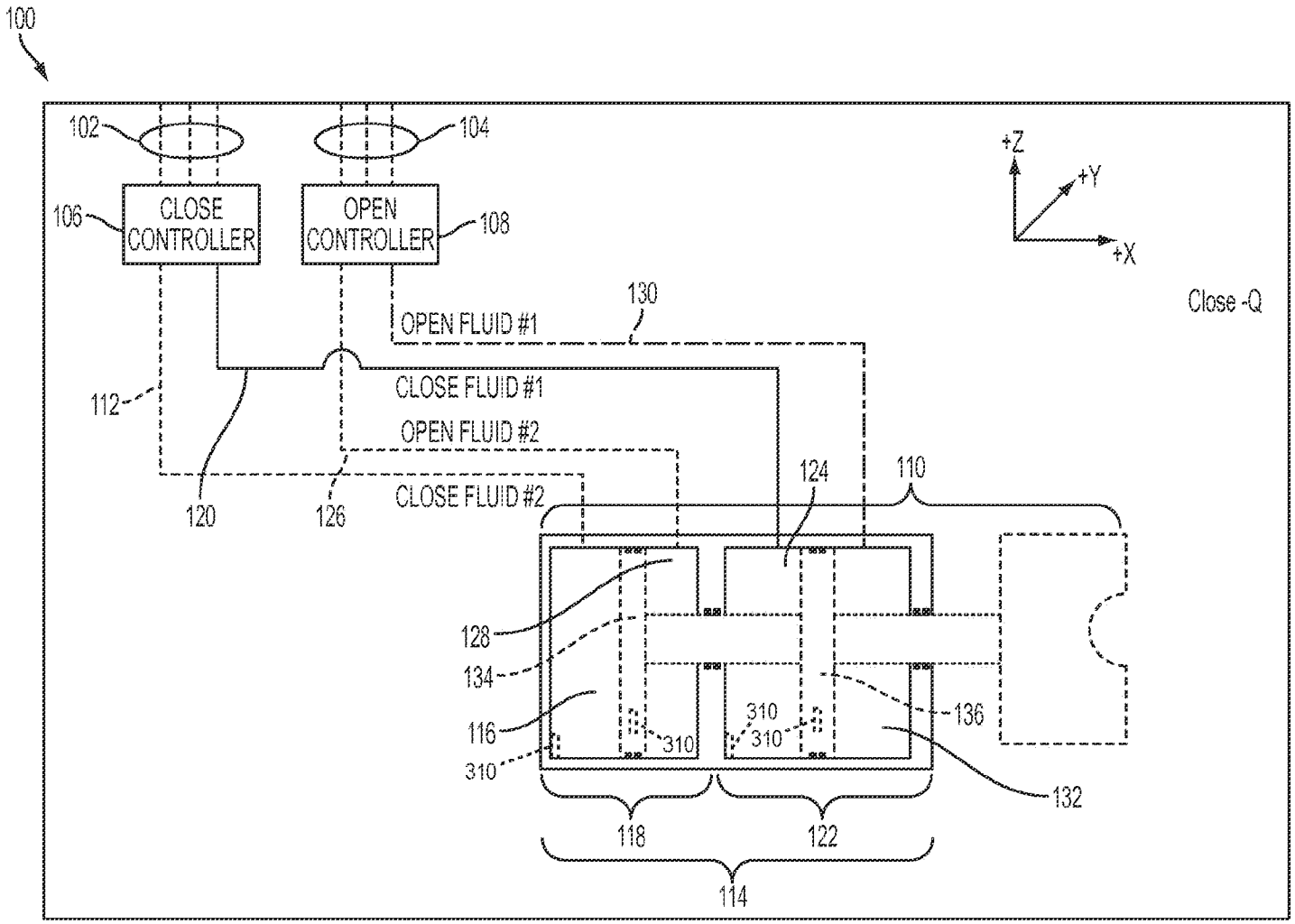
FIG. 1 is a block diagram illustrating a system with redundant controls and hydraulic actuators according to one embodiment of the disclosure.

FIG. 1 is a block diagram illustrating a system with redundant controls and hydraulic actuators according to one embodiment of the disclosure. The system 100 may include a first set of hydraulic lines 102 coupled to a first controller 106 and a second set of hydraulic lines 104 coupled to a second controller 108. In some embodiments, the hydraulic lines may be coupled to the controllers via conduits, hoses, pipes, and/or the like. The first set of hydraulic lines 102 and the second set of hydraulic lines 104 may transfer hydraulic fluid from a fluid source (not shown) or multiple fluid sources (not shown) to the first controller 106 and the second controller 108, respectively. The fluid source may, according to an embodiment, store subsea water, fresh water, treated water, an oil-based fluid, or any other fluid capable of flowing through a hydraulic device. The fluid source may be realized in various ways, such as with a flexible material that can change volume or a rigid structure. For example, the fluid source may be a reservoir, an open water source, another hydraulic device, and/or the like. In other embodiments, the fluid source may be a mechanical device, a gas accumulator, a spring biased accumulator, a pipe, a piston, and/or the like. In one embodiment, the fluid source may be located on the water surface and/or subsea. In general, the fluid source may be located anywhere (e.g., onshore, on the water surface, subsea), and may be any structure, flexible or rigid, that supplies the fluid in the hydraulic lines, such as the first set of hydraulic lines 102 and the second set of hydraulic lines 104.

According to an embodiment, each hydraulic line in the first set of hydraulic lines 102 may transfer fluid in parallel to the first controller 106, and the hydraulic fluid in each hydraulic line of the first set of hydraulic lines 102 may have the same pressure. Similarly, each hydraulic line in the second set of hydraulic lines 102 may transfer fluid in parallel to the second controller 106, and the hydraulic fluid in each hydraulic line of the second set of hydraulic lines 102 may have the same pressure. According to other embodiments, the pressure in the parallel hydraulic lines, either in the first set 102 or the second set 104, may vary across the hydraulic lines.

According to some embodiments, the first set of hydraulic lines 102 may provide the hydraulic fluid used to actuate the hydraulic device 110 in a first direction, while the second set of hydraulic lines 104 may provide the hydraulic fluid used to actuate the hydraulic device 110 in a second direction, which may be opposite to the first direction. For example, in one embodiment in which the hydraulic device 110 may be a BOP ram, the first set of hydraulic lines 102 may provide the hydraulic fluid used to close the ram, while the second set of hydraulic lines 104 may provide the hydraulic fluid used to open the ram.

By sending three parallel hydraulic lines with the same pressure, redundancy may be incorporated in the control of the hydraulic device 110. According to one embodiment, as shown in FIG. 1, the first controller 106 may be configured to select from at least three different hydraulic lines in the first set of hydraulic lines 102 and allow the fluid from at least one of the hydraulic lines in the first set of hydraulic lines 102 to be transferred along a first hydraulic actuation line 112 to the actuator 114 of the hydraulic device 110. For example, in one embodiment, the first controller 106 may select a first hydraulic line of the first set 102, and transfer the hydraulic fluid in the selected first hydraulic line of the first set 102 through the first hydraulic actuation line 112 to a first cavity 116 of the first hydraulic actuator 118. Because the first controller 106 in FIG. 1 receives a first set of hydraulic lines 102 that includes at least three different hydraulic lines, should faults or failures, such as leaks, be encountered in any one of the lines of the first set 102, the first controller 106 and actuator 114 may still operate undeterred by the fault or failure by transferring fluid through the first actuation line 112 from a different hydraulic line of the first set 102 that does not exhibit faults or failures.

According to an embodiment, as shown in FIG. 1, the actuator 114 may include two hydraulic actuators 118 and 122. Therefore, in some embodiments, the first controller 106 may select a second hydraulic line of the first set 102, and transfer the hydraulic fluid in the selected second hydraulic line of the first set 102 through a second hydraulic actuation line 120 to a first cavity 124 of the second hydraulic actuator 122. As discussed previously, the transfer of fluid to the second hydraulic actuator 122 may be more reliable and available than conventional systems because the first controller 106 may receive multiple hydraulic lines, such as the first set of hydraulic lines 102, thereby increasing the likelihood that the second actuator 122 will receive hydraulic fluid when needed.

Similarly, the second controller 108 may select a first hydraulic line of the second set 104, and transfer the hydraulic fluid in the selected first hydraulic line of the second set 104 through a third hydraulic actuation line 126 to a second cavity 128 of the first hydraulic actuator 118. The second controller 108 may also select a second hydraulic line of the second set 104, and transfer the hydraulic fluid in the selected second hydraulic line of the second set 104 through a fourth actuation line 130 to a second cavity 132 of the second hydraulic actuator 122. Because the second controller 108 also receives multiple hydraulic lines via the second set of hydraulic lines 104, the improved reliability, availability, and/or fault tolerance associated with the first hydraulic actuator 118 that results from the redundancy in hydraulic lines received by the first controller 106 may also be exhibited by the second hydraulic actuator 122 as a result of the redundancy in hydraulic lines received by the second controller 108.

As shown in FIG. 1, in addition to the redundancy in the number of hydraulic lines received by the first controller 106 and the second controller 108, the system 100 also illustrates redundancy in the actuation of the hydraulic device 110. For example, the hydraulic actuator 114 of the hydraulic device 110 may be split into two separate hydraulic actuators 118 and 122. The redundancy exhibited by the actuator 114 by incorporating a first hydraulic actuator 118 and a second hydraulic actuator 122 allows for a second level of increased reliability, availability, and/or fault tolerance, as will be illustrated in the description of FIG. 3.

Figure 2:
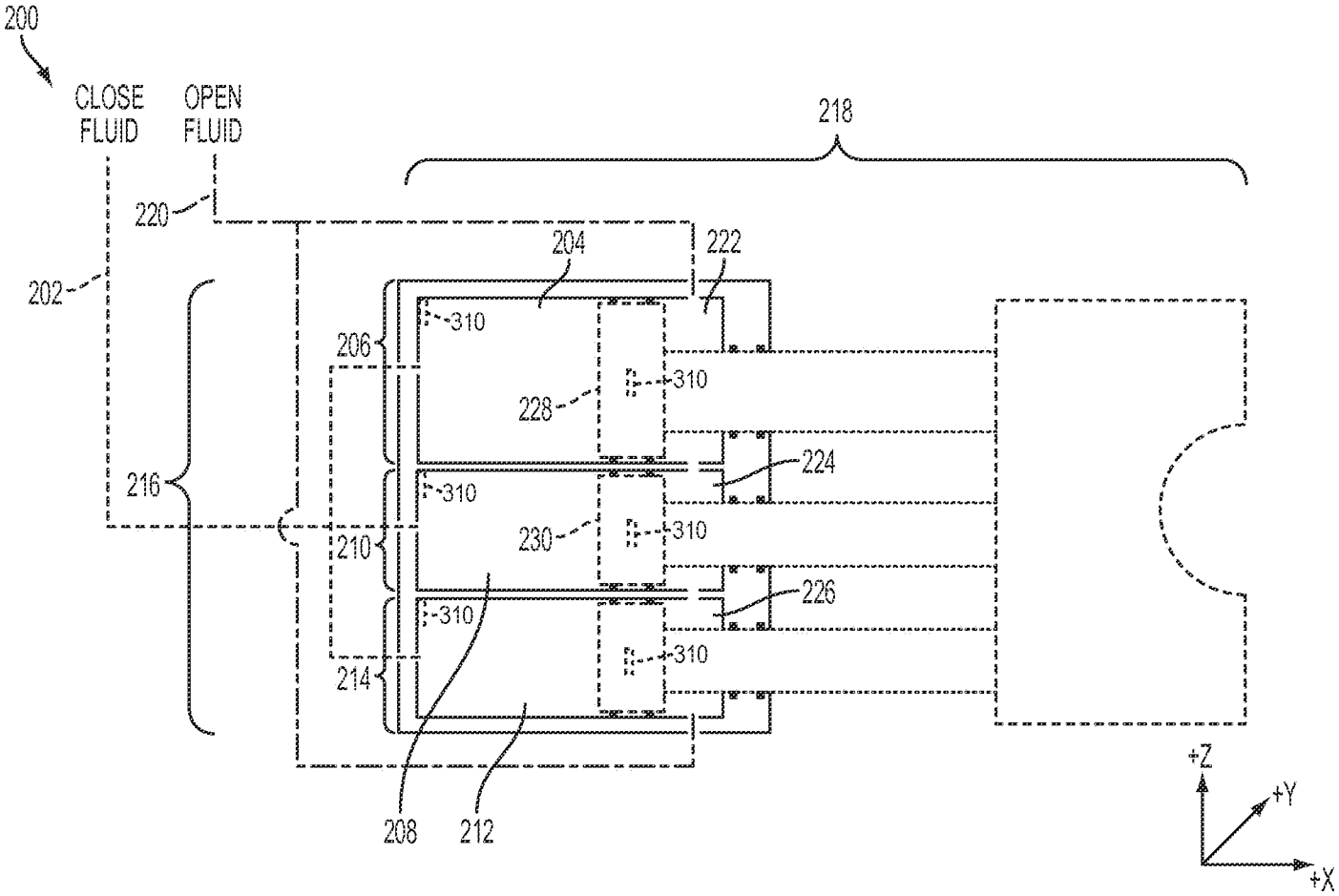
FIG. 2 is a block diagram that also illustrates a system with redundant controls and/or hydraulic actuators according to one embodiment of the disclosure.

Although FIG. 1 illustrates one embodiment in which the first hydraulic actuator 118 and the second hydraulic actuator 122 of the overall hydraulic actuator 114 are in series, the subset of hydraulic actuators, such as first hydraulic actuator 118 and second hydraulic actuator 122, of an overall hydraulic actuator system, such as hydraulic actuator 114, may also operate in parallel. For example, FIG. 2 is a block diagram that also illustrates a system with redundant controls and/or hydraulic actuators according to one embodiment of the disclosure. System 200 illustrates an embodiment in which the hydraulic fluid used to close a BOP function, such as a ram, may be distributed to different cavities from one hydraulic actuation line as opposed to having a separate hydraulic actuation line for each cavity, as illustrated in FIG. 1. As an example, hydraulic fluid in a first hydraulic actuation line 202 may be distributed to a first cavity 204 of a first actuator 206, a first cavity 208 of a second actuator 210, and a first cavity 212 of a third actuator 214 that make up an overall actuator 216 of a hydraulic device 218. In one embodiment, the supply of fluid in the first hydraulic actuation line 202 may be controlled by a controller, such as first controller 106 of FIG. 1, and the fluid in the first hydraulic actuation line 202 may be provided by a set of hydraulic lines that couple to the controller, such as the first set of hydraulic lines 102 of FIG. 1.

Similarly, as shown in FIG. 2, hydraulic fluid in a second hydraulic actuation line 220 may be distributed to a second cavity 222 of a first actuator 206, a second cavity 224 of a second actuator 210, and a second cavity 226 of a third actuator 214 that make up an overall actuator 216 of a hydraulic device 218. In one embodiment, the supply of fluid in the second hydraulic actuation line 220 may be controlled by a controller, such as second controller 108 of FIG. 1, and the fluid in the second hydraulic actuation line 220 may be provided by a set of hydraulic lines that couple to the controller, such as the second set of hydraulic lines 104 of FIG. 1.

In some embodiments, each cavity associated with each of the subset of hydraulic actuators 206, 210, and 214 that make up the overall hydraulic actuator 216 may have a dedicated hydraulic actuation line, as was illustrated in FIG. 1. Furthermore, because a controller, such as first controller 106 or second controller 108 of FIG. 1, may control the supply of fluid to the first hydraulic actuation line 202 and the second hydraulic actuation line 220 of FIG. 2, the improved reliability, availability, and/or fault tolerance associated with the overall hydraulic actuator 114 of FIG. 1 that results from the redundancy in hydraulic lines received by the first controller 106 and the second controller 108 may also be exhibited by the overall hydraulic actuator 216 of FIG. 2 as a result of the redundancy in hydraulic lines received by the controllers that control the supply of fluid to the first hydraulic actuation line 202 and the second hydraulic actuation line 220 of FIG. 2.

Whereas FIG. 1 illustrated an embodiment in which hydraulic actuators may be series redundant, FIG. 2 illustrated an embodiment in which hydraulic actuators may be parallel redundant. Hydraulic actuators may, in general, be series redundant, parallel redundant, and/or a combination of series and parallel redundant without departing from this disclosure in spirit or scope. Furthermore, whereas FIG. 1 illustrated an embodiment in which cavities of hydraulic actuators had dedicated hydraulic actuation lines to supply hydraulic fluid, FIG. 2 illustrated an embodiment in which multiple cavities may receive hydraulic fluid that is distributed from a hydraulic actuation line. Cavities may, in general, receive hydraulic fluid from dedicated, distributed, and/or a combination of dedicated and distributed hydraulic actuation lines without departing from this disclosure in spirit or scope.

In some embodiments, the advantages of redundancy may be extended beyond a controller to the hydraulic device. For example, in some embodiments, each controller in the system, such as, for example, controller 106 or controller 108, may have a set of hydraulic lines being output from the controller, and each output hydraulic line may correspond to an input hydraulic line. In such embodiments, each hydraulic line illustrated in FIG. 1 and/or FIG. 2, such as, for example, hydraulic lines 112, 120, 126, or 130, may correspond to a set of redundant hydraulic lines output from the controller. For example, hydraulic line 112 may correspond to one set of redundant hydraulic lines and hydraulic line 120 may correspond to another set of redundant hydraulic lines.

Figure 3:
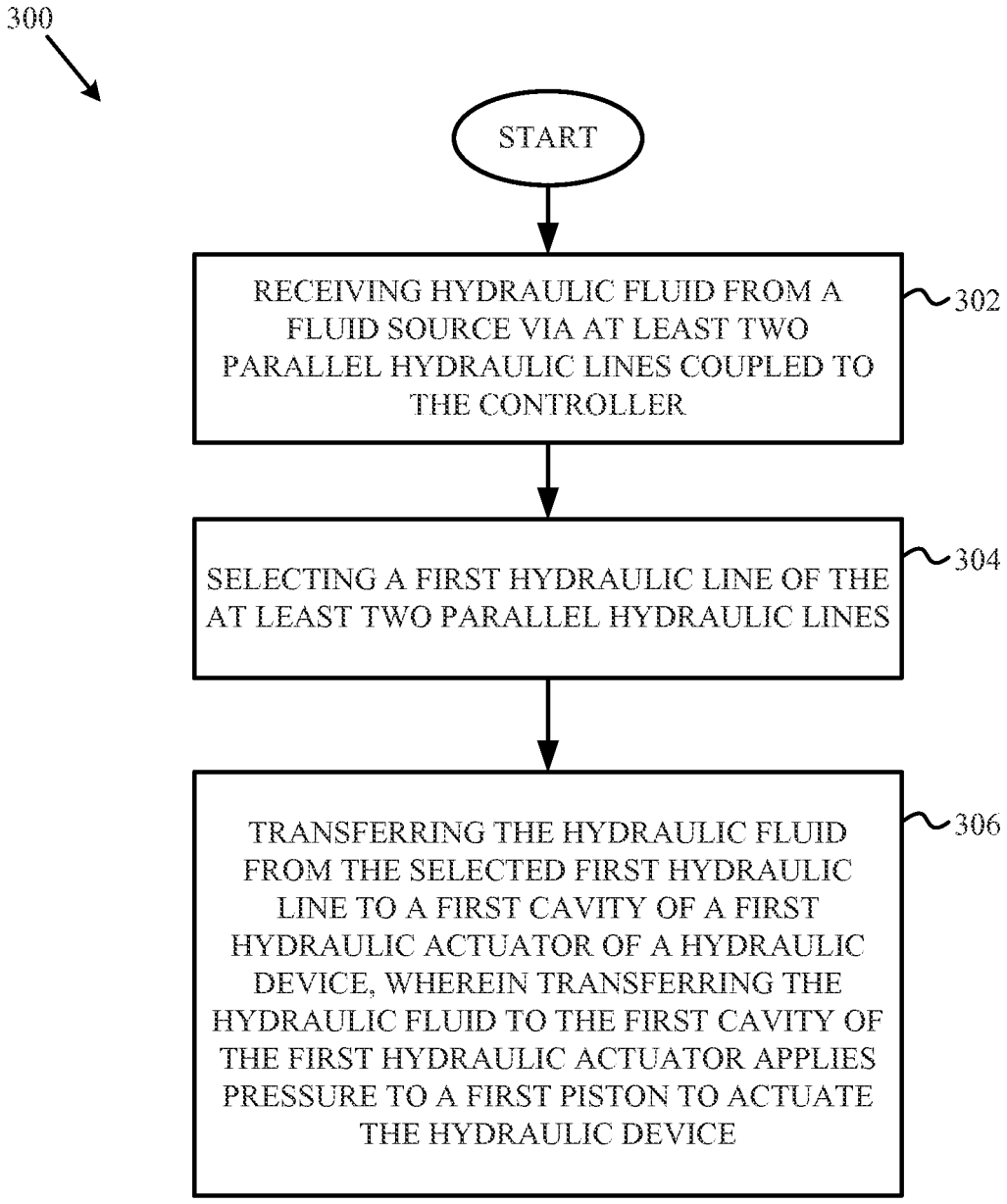
FIG. 3 is a flow chart illustrating a method for redundant actuation of a hydraulic device according to one embodiment of the disclosure.

The redundancy incorporated into the control of hydraulic fluid to actuators and into the actuators themselves, as illustrated in FIG. 1 and/or FIG. 2, may significantly improve the reliability, availability, and/or fault tolerance of a hydraulic device by reducing the impact that a faulty connection and/or actuator has on the operation of a hydraulic device. For example, FIG. 3 provides a flow chart illustrating a method for redundant actuation of a hydraulic device according to one embodiment of the disclosure. Method 300 may begin at block 302 with receiving, at a controller, hydraulic fluid from a fluid source via at least two parallel hydraulic lines coupled to the controller. Referring to FIG. 1, the controller referenced at block 302 may, according to one embodiment, be first controller 106, and the at least two parallel hydraulic lines may be at least two lines of the first set of hydraulic lines 102. In some embodiments, a controller may include at least a control valve to manage the transfer of fluid to and from the controller.

At block 304, method 300 may include selecting, by the controller, a first hydraulic line of the at least two parallel hydraulic lines, and at block 306, method 300 may include transferring, by the controller, the hydraulic fluid from the selected first hydraulic line to a first cavity of a first hydraulic actuator of a hydraulic device, wherein transferring the hydraulic fluid to the first cavity of the first hydraulic actuator applies pressure to a first piston to actuate the hydraulic device. For example, referring back to FIG. 1, the first cavity of the first hydraulic actuator may, in one embodiment, include the first cavity 116 of the first hydraulic actuator 118. Furthermore, the first piston may be first piston 134 of FIG. 1, and the hydraulic device may be hydraulic device 110 of FIG. 1. According to an embodiment, when hydraulic fluid is transferred to the first cavity, such as first cavity 116, the pressure in the cavity may rise such that the pressure gets applied to the first piston, such as first piston 134, which subsequently actuates the hydraulic device. For example, when the hydraulic device is a BOP ram and the actuator is configured as illustrated in FIG. 1, then application of pressure on the first piston 134 as a result of hydraulic fluid transferred to first cavity 116 may cause the first piston 134 to move in the positive x direction, which in some embodiments, may cause the BOP ram to close.

In other embodiments, the first cavity of the first hydraulic actuator at block 306 may include the first cavity 204 of the first hydraulic actuator 206. Furthermore, the first piston may be first piston 228 of FIG. 2, and the hydraulic device may be hydraulic device 218 of FIG. 2. Therefore, when the hydraulic device is a BOP ram and the actuator is configured as illustrated in FIG. 2, then application of pressure on the first piston 228 as a result of hydraulic fluid transferred to first cavity 204 may cause the first piston 228 to move in the positive x direction, which in some embodiments, may also cause the BOP ram to close.

According to an embodiment, the first controller may also select a second hydraulic line of the at least two hydraulic lines transferred in parallel, and transfer the hydraulic fluid from the selected second hydraulic line to a first cavity of a second hydraulic actuator. In some embodiments, transferring the hydraulic fluid to the first cavity of the second hydraulic actuator may apply pressure to a second piston to further actuate the hydraulic device. For example, referring back to FIG. 1, the first cavity of the second hydraulic actuator may, in one embodiment, include the first cavity 124 of the second hydraulic actuator 122. Furthermore, the second piston may be second piston 136 of FIG. 1, and the hydraulic device may be hydraulic device 110 of FIG. 1. According to an embodiment, when hydraulic fluid is transferred to the first cavity, such as first cavity 124, the pressure in the cavity may rise such that the pressure gets applied to the second piston, such as second piston 136, which subsequently actuates the hydraulic device 110. Therefore, when the hydraulic device is a BOP ram and the actuator is configured as illustrated in FIG. 1, then application of pressure on the second piston 136 as a result of hydraulic fluid transferred to first cavity 124 of the second actuator 122 may cause the second piston 136 to provide additional force in the positive x direction, which in some embodiments, may cause the BOP ram to close even faster.

As described above with reference to FIG. 1, when the pressure applied to the second piston 136 is equal to the pressure being applied to the first piston 134, the BOP ram may close even faster than when pressure was only being applied to the first piston 134. In other embodiments, the pressure applied to the first piston 134 and the pressure applied to the second piston 136 may remain equal, but be reduced when pressure is applied to the second piston 136 in addition to the first piston 134. By reducing the pressure applied to both the first piston 134 and the second piston 136, the BOP ram may close at a slower rate, which may be desirable when the ram is closing at an unreliable or unsafe fast rate. In other embodiments, the pressure applied to the second piston 136 may be different than the pressure applied to the first piston 134. For example, the first controller 106 may receive an additional set of hydraulic lines holding hydraulic fluid with less pressure, and the first controller 106 may transfer the lower pressure hydraulic fluid to the first cavity 124 of the second hydraulic actuator 122. By applying a variable pressure to the second piston 136, the BOP ram may be controlled to close at a desired rate.

In another embodiment, hydraulic fluid from the selected first hydraulic line, such as the first hydraulic line selected at block 304, may be transferred to a first cavity of a second hydraulic actuator. In some embodiments, transferring the hydraulic fluid to the first cavity of the second hydraulic actuator may apply pressure to a second piston to further actuate the hydraulic device. For example, referring back to FIG. 2, the first cavity of the second hydraulic actuator may, in one embodiment, include the first cavity 208 of the second hydraulic actuator 210. Furthermore, the second piston may be second piston 230 of FIG. 2, and the hydraulic device may be hydraulic device 218 of FIG. 2. Therefore, when the hydraulic device is a BOP ram and the actuator is configured as illustrated in FIG. 2, then application of pressure on the second piston 230 as a result of hydraulic fluid transferred to the first cavity 208 may cause the second piston 230 to provide force in the positive x direction, which in some embodiments, may cause the BOP ram to close at the same rate or a different rate than before. For example, as mentioned previously with respect to FIG. 1, the pressure applied to each of the first piston 228 and the second piston 230 may be varied to modify the rate, if any, at which the BOP ram may close.

As illustrated in FIGS. 1-3, pressure may be applied to the pistons, which may be arranged in a variety of combinations, in a variety of ways to actuate a hydraulic device. For example, as disclosed previously, hydraulic actuators may, in general, be series redundant, parallel redundant, and/or a combination of series and parallel redundant. Therefore, according to embodiments, at least a first piston and a second piston may be arranged in series, parallel, and/or a combination of series and parallel to actuate a hydraulic device.

In some embodiments, the first controller may also be configured to detect a failure associated with at least a first hydraulic actuator and/or a second hydraulic actuator. For example, in some embodiments, a plurality of sensors (e.g., 310) may be coupled to each of the hydraulic actuators in the hydraulic device, and more specifically to each of the pistons and/or cavities of the hydraulic actuators in a hydraulic device. In one embodiment, the plurality of sensors (e.g., 310) may be coupled at least to each of at least a first piston, first cavity of a first hydraulic actuator, second piston, and/or second cavity of a second hydraulic actuator. The first controller may then communicate, such as, for example, via electrical communication, with each of the sensors to receive signals from each of the plurality of sensors (e.g., 310).

According to an embodiment, the signals from the sensors (e.g., 310) may include information/data associated with the operation status of each of the hydraulic actuators in the system, and more specifically information/data associated with at least pistons and/or cavities associated with each of the actuators in the system. The data obtained by the sensors (e.g., 310) may be indicative of at least one of pressure, flow rate, temperature, conductivity, pH, position, velocity, acceleration, current, and voltage. The first controller may then, according to some embodiments, process the signals from the plurality of sensors (e.g., 310) with a processor located within the first controller to detect a failure associated with any of the hydraulic actuators in the system and/or any of the specific features of a hydraulic actuator in the system. In addition to including the processor, the first controller may also include a memory to store information/data.

According to an embodiment, upon detecting a failure, such as a failure associated with a second hydraulic actuator, the pressure of the hydraulic fluid in the parallel hydraulic lines, such as the hydraulic lines in the first set 102, may be increased to increase the pressure applied to the first piston. The additional pressure may be necessary to compensate for the faulty second hydraulic actuator and further actuate the hydraulic device to ensure that the hydraulic device continues to operate even after component failures. In other embodiments in which the first hydraulic actuator is faulty or detected to exhibit a failure, the pressure of the hydraulic fluid in the parallel hydraulic lines, such as the hydraulic lines in the first set 102, may be increased to increase the pressure applied to the second piston. As was the case for the first hydraulic actuator, the additional pressure may be necessary to compensate for the faulty first hydraulic actuator and further actuate the hydraulic device to ensure that the hydraulic device continues to operate even after component failures. In general, the first controller may detect a failure with any of the actuators that are included within the hydraulic device, and upon detecting a failure with one particular actuator, the pressure associated with the other actuators (i.e., those other than the faulty actuator) may be modified to compensate for the faulty device. In other embodiments, the pressure may not need to be modified to compensate for the faulty actuator. According to one embodiment, the pressure in the hydraulic lines that are coupled to the controllers may be modified by modifying the pressure applied at the fluid source that supplies the hydraulic fluid.

In some embodiments, the controllers may receive input, and may modify the pressure applied to components of non-faulty actuators and/or modify the transfer of fluid to faulty and/or non-faulty actuators based on the input received. For example, in one embodiment, the controllers may be in communication, such as, for example, electrical, acoustic, and/or fluid communication, with a user interface on an offshore drilling rig, and an operator on the offshore drilling rig, such as a well operator, may provide input at the interface which can be communicated to the controllers in order to modify the transfer of fluid to the hydraulic actuators in the system.

According to some embodiments, when an actuator or a specific feature of an actuator, such as a cavity or piston, is detected to exhibit a failure, the faulty component may need to be deactivated or sealed. For example, in one embodiment in which the cavity or the piston of an actuator has a leak, which is one type of failure, then the leaking cavity, piston, and possibly even the entire actuator associated with the leaking cavity and/or piston may need to be sealed to prevent any pressure losses. Because of the redundancy incorporated into the system, a faulty actuator may be completed sealed and/or removed and repaired without affecting the overall performance of the hydraulic device because of the redundant controls and/or actuators that compensated for the faulty component.

According to an embodiment, the functionality of the second controller may be identical to the functionality of the first controller with the exception that the second controller may control the transfer of fluids used to perform a different hydraulic function than the fluid for which transfer is controlled by the first controller. For example, in one embodiment, the second controller may control the transfer of hydraulic fluid used to open a BOP ram whereas the first controller may control the transfer of hydraulic fluid used to close a BOP ram. In any case, the second controller may also detect failures, receive input from a user interface, and modify the transfer of fluid to the actuators in the system based on a detected failure and/or received input. Furthermore, as shown in FIG. 1 and/or FIG. 2, whereas the first controller may control the transfer of fluid to one side of a piston, the second controller may control the transfer of fluid to another side of the same piston. Therefore, any functionality associated with the first controller may also be associated with the second controller, albeit for a different purpose.

Although FIG. 1 illustrates an embodiment in which the actuator incorporates dual redundancy and FIG. 2 illustrates an embodiment in which the actuator incorporates triple redundancy, in general, an actuator may incorporate any level of redundancy, and the choice of the level of redundancy may be application specific. For example, in one embodiment, an actuator may incorporate octuplet redundancy, while in another embodiment, an actuator may incorporate quintuple redundancy.

In some embodiments, the controllers 106 and 108 may include control circuits. The control circuits may include one or more valve controllers, where each valve controller may be in communication, such as, for example, electrical communication, with at least one of the one or more valves. The control circuit may be configured to adjust the transfer of fluid to the hydraulic device by selectively varying the position of valves between an open and a closed position.

As mentioned above, a controller, such as controller 106 or 108, may include a processor to process information and/or signals received at the controller. The controller may be configured to perform various functions based on the processing of the information and/or signals. The controller may also include memory, which may be electrically coupled to the processor, to store data at the controller.

The controller is not limited to the specific structure disclosed herein. One of skill in the art would readily recognize that other structures are possible, and that the controller disclosed herein can encompass such structures so long as the structures are configured to perform the functions of the controller as described herein. If implemented in firmware and/or software, the some of the functions described above may be stored as one or more instructions or code on a computer-readable medium. Examples include non-transitory computer-readable media encoded with a data structure and computer-readable media encoded with a computer program. Computer-readable media includes physical computer storage media. A storage medium may be any available medium that can be accessed by a computer, computing device, and/or general processor. By way of example, and not limitation, such computer-readable media can comprise RAM, ROM, EEPROM, CD-ROM or other optical disk storage, magnetic disk storage or other magnetic storage devices, or any other medium that can be used to store desired program code in the form of instructions or data structures and that can be accessed by a computer, computing device, and/or general processor. Disk and disc includes compact discs (CD), laser discs, optical discs, digital versatile discs (DVD), floppy disks and blu-ray discs. Generally, disks reproduce data magnetically, and discs reproduce data optically. Combinations of the above should also be included within the scope of computer-readable media.

In addition to storage on computer-readable medium, instructions and/or data may be provided as signals on transmission media included in a communication apparatus. For example, a communication apparatus may include a transceiver having signals indicative of instructions and data, and a memory for storing data, information, instructions, and/or the like. The instructions and data are configured to cause one or more processors to implement the functions outlined in the disclosure and the claims.

The above specification and examples provide a complete description of the structure and use of illustrative embodiments. Although certain embodiments have been described above with a certain degree of particularity, or with reference to one or more individual embodiments, those skilled in the art could make numerous alterations to the disclosed embodiments without departing from the scope of this invention. As such, the various illustrative embodiments of the methods and systems are not intended to be limited to the particular forms disclosed. Rather, they include all modifications and alternatives falling within the scope of the claims, and embodiments other than the one shown may include some or all of the features of the depicted embodiment. For example, elements may be omitted or combined as a unitary structure, and/or connections may be substituted. Further, where appropriate, aspects of any of the examples described above may be combined with aspects of any of the other examples described to form further examples having comparable or different properties and/or functions, and addressing the same or different problems. Similarly, it will be understood that the benefits and advantages described above may relate to one embodiment or may relate to several embodiments.

The claims are not intended to include, and should not be interpreted to include, means-plus- or step-plus-function limitations, unless such a limitation is explicitly recited in a given claim using the phrase(s) "means for" or "step for," respectively.

What is claimed is:

1. A hydraulic apparatus, comprising:

a hydraulic device having a first hydraulic actuator and a second hydraulic actuator, wherein each of the first and second hydraulic actuators comprises at least a first hydraulic cavity, a second hydraulic cavity, and a piston; and a controller coupled to the hydraulic device, wherein the controller is configured to:

receive hydraulic fluid from a fluid source via at least two parallel hydraulic lines coupled to the controller;

select a first hydraulic line of the at least two parallel hydraulic lines;

transfer hydraulic fluid from the first hydraulic line to the first cavity of the first hydraulic actuator, wherein transferring the hydraulic fluid to the first cavity of the first hydraulic actuator applies pressure to the piston of the first hydraulic actuator to actuate the hydraulic device;

receive one or more signals from a plurality of sensors coupled to at least one of the piston of the first hydraulic actuator, the first cavity of the first hydraulic actuator, the piston of the second hydraulic actuator, and the first cavity of the second hydraulic actuator; and detect a failure associated with at least one of the first hydraulic actuator and the second hydraulic actuator based, at least in part, on the one or more signals received from the plurality of sensors; and upon detecting the failure, increase a pressure of hydraulic fluid in at least one of the at least two parallel hydraulic lines to increase a pressure applied to at least one of the piston of the first hydraulic actuator and the piston of the second hydraulic actuator to further actuate the hydraulic device.

2. The apparatus of claim 1, wherein the controller is further configured to:

select a second hydraulic line of the at least two parallel hydraulic lines; and transfer hydraulic fluid from the second hydraulic line to the first cavity of the second hydraulic actuator, wherein transferring the hydraulic fluid to the first cavity of the second hydraulic actuator applies pressure to the piston of the second hydraulic actuator to further actuate the hydraulic device.

3. The apparatus of claim 1, wherein the controller is further configured to transfer hydraulic fluid from the first hydraulic line to the first cavity of the second hydraulic actuator, wherein transferring the hydraulic fluid to the first cavity of the second hydraulic actuator applies pressure to the piston of the second hydraulic actuator to further actuate the hydraulic device.

4. The apparatus of claim 1, wherein the first hydraulic actuator and the second hydraulic actuator are coupled in series.

5. The apparatus of claim 1, wherein the first hydraulic actuator and the second hydraulic actuator are coupled in parallel.

6. A method for redundant actuation of a hydraulic device, comprising:

receiving, at a controller, hydraulic fluid from a fluid source via at least two parallel hydraulic lines coupled to the controller;

selecting, by the controller, a first hydraulic line of the at least two parallel hydraulic lines;

transferring, by the controller, hydraulic fluid from the first hydraulic line to a first cavity of a first hydraulic actuator of a hydraulic device, wherein transferring the hydraulic fluid to the first cavity of the first hydraulic actuator applies pressure to a piston of the first hydraulic actuator to actuate the hydraulic device;

receiving one or more signals from a plurality of sensors coupled to at least one of the piston of the first hydraulic actuator, the first cavity of the first hydraulic actuator, a piston of a second hydraulic actuator, and a first cavity of the second hydraulic actuator; and detecting a failure associated with at least one of the first hydraulic actuator and the second hydraulic actuator based, at least in part, on the one or more signals received from the plurality of sensors; and upon detecting the failure, increasing a pressure of hydraulic fluid in at least one of the at least two parallel hydraulic lines to increase a pressure applied to at least one of the piston of the first hydraulic actuator and the piston of the second hydraulic actuator to further actuate the hydraulic device.

7. The method of claim 6, further comprising:

selecting a second hydraulic line of the at least two parallel hydraulic lines; and transferring hydraulic fluid from the second hydraulic line to the first cavity of the second hydraulic actuator of the hydraulic device, wherein transferring the hydraulic fluid to the first cavity of the second hydraulic actuator applies pressure to the piston of the second hydraulic actuator to further actuate the hydraulic device.

8. The method of claim 6, further comprising transferring hydraulic fluid from the first hydraulic line to the first cavity of the second hydraulic actuator, wherein transferring the hydraulic fluid to the first cavity of the second hydraulic actuator applies pressure to the piston of the second hydraulic actuator to further actuate the hydraulic device.

9. The method of claim 7, wherein the first hydraulic actuator and the second hydraulic actuator are coupled in series.

10. The method of claim 7, wherein the first hydraulic actuator and the second hydraulic actuator are coupled in parallel.

11. The method of claim 8, wherein the first hydraulic actuator and the second hydraulic actuator are coupled in series.

12. The method of claim 8, wherein the first hydraulic actuator and the second hydraulic actuator are coupled in parallel.

* * * * *